US011939703B2

(12) United States Patent
Koehne

(10) Patent No.: US 11,939,703 B2
(45) Date of Patent: Mar. 26, 2024

(54) METHOD FOR PRODUCING GRAPHENE FIBRES

(71) Applicant: Robert Bosch GmbH, Stuttgart (DE)

(72) Inventor: Martin Koehne, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 329 days.

(21) Appl. No.: 17/625,721

(22) PCT Filed: May 29, 2020

(86) PCT No.: PCT/EP2020/064995
§ 371 (c)(1),
(2) Date: Jan. 7, 2022

(87) PCT Pub. No.: WO2021/004692
PCT Pub. Date: Jan. 14, 2021

(65) Prior Publication Data

US 2022/0290336 A1 Sep. 15, 2022

(30) Foreign Application Priority Data

Jul. 10, 2019 (DE) ..... 10 2019 210 211.5

(51) Int. Cl.

| | |
|---|---|
| ***D01F 9/12*** | (2006.01) |
| ***D01D 5/04*** | (2006.01) |
| ***D01D 5/06*** | (2006.01) |
| ***D01F 1/09*** | (2006.01) |
| ***D01F 11/10*** | (2006.01) |

(52) U.S. Cl.
CPC ..... *D01F 9/12* (2013.01); *D01D 5/04* (2013.01); *D01D 5/06* (2013.01); *D01F 1/09* (2013.01); *D01F 11/10* (2013.01)

(58) Field of Classification Search
CPC ..... D01F 9/12
See application file for complete search history.

(56) References Cited

U.S. PATENT DOCUMENTS

2015/0093572 A1* 4/2015 Zhou ..... D01F 9/12 428/367

FOREIGN PATENT DOCUMENTS

| | | | |
|---|---|---|---|
| CN | 105544016 | A | 5/2016 |
| CN | 105544017 | A | 5/2016 |
| CN | 105603581 | A | 5/2016 |
| CN | 106702732 | A | 5/2017 |
| CN | 108707998 | A | 10/2018 |
| EP | 2837716 | A1 | 2/2015 |
| WO | 2017179900 | A1 | 10/2017 |

OTHER PUBLICATIONS

Translation of International Search Report for Application No. PCT/EP2020/064995 dated Sep. 3, 2020 (2 pages).

* cited by examiner

*Primary Examiner* — Andrew T Piziali

(74) *Attorney, Agent, or Firm* — Michael Best & Friedrich LLP

(57) ABSTRACT

The invention relates to a method for producing graphene fibres, comprising the following steps: a. providing single- or multi-layer graphene or graphene oxide platelets based on graphene or graphene oxide; b applying a transition metal or a transition metal oxide to the graphene or graphene oxide platelets by means of a deposition method; c. spinning, in particular wet-spinning or dry-spinning, a graphene fibre or graphene oxide fibre by injecting a spinning solution, in which the graphene or graphene oxide platelets obtained in step b) are dispersed; d. treating, in particular reducing, the graphene fibre or the graphene oxide fibre in a process atmosphere containing a reducing agent, in particular hydrogen, at a determined treatment temperature; wherein, where there is a graphene oxide fibre, this is reduced to form a graphene fibre, wherein the graphene fibre or graphene oxide fibre is treated in such a way that the transition metal oxide in step d) is only partially reduced or the transition metal in a step following step d) is partially oxidised, wherein the partial reducing or partial oxidation occurs, in particular in such a way that there is a certain proportion of the transition metal oxide in the finished graphene fibre that is smaller than the proportion of the transition metal, in particular smaller than 10 wt. %.

23 Claims, No Drawings

METHOD FOR PRODUCING GRAPHENE FIBRES

BACKGROUND OF THE INVENTION

The invention relates to a process for producing graphene fibers and a graphene fiber.

Processes for producing graphene fibers are already known, from CN 105603581 A, CN 105544016 A or CN 105544017 A, in which graphene fibers are produced using graphene oxide, which can be produced at favorable cost from graphite by wet-chemical oxidation. At the end of these production processes, for the purpose of increasing the electrical conductivity of the graphene fibers, a thermal treatment is needed in a strongly reducing atmosphere at temperatures of several hundred degrees of Celsius. This is followed by a further thermal treatment of more than 2000° C. for healing defects.

It is also known practice to increase the conductivity of graphene fibers by means of extrinsic doping with metals having very good electrical conductivity. For example, potassium is introduced into the graphene fiber by thermal diffusion. Potassium, however, is unstable in air, and so the doping effect on graphene is lost on air contact.

SUMMARY OF THE INVENTION

The process of the invention has the advantage, conversely, that graphene fibers having a high electrical conductivity can be produced with the process. In the invention the graphene fibers are doped by a transition metal and additionally by the corresponding transition metal oxide. Although the electrical conductivity of the transition metal oxide is lower than that of the corresponding transition metals, the higher extrinsic doping activity of the transition metal oxides nevertheless means that the graphene fiber of the invention achieves a higher electrical conductivity.

This is achieved in the invention by means of the following process steps:

a) providing single-layer or multilayer graphene flakes or graphene oxide flakes based on graphene or on graphene oxide, b) applying a transition metal or a transition metal oxide to the graphene flakes or graphene oxide flakes by means of a deposition process, c) spinning, more particularly wet spinning or dry spinning, a graphene fiber or graphene oxide fiber by injection of a spinning solution comprising in dispersed form the graphene flakes or graphene oxide flakes obtained from step b), d) treating, more particularly reducing, the graphene fiber or the graphene oxide fiber in a process atmosphere containing a reducing agent, more particularly hydrogen, at a defined treatment temperature, wherein a graphene oxide fiber, if present, is reduced to a graphene fiber, wherein the graphene fiber or graphene oxide fiber is treated such that the transition metal oxide in step d) is only partially reduced or such that the transition metal in a step following step d) is partially oxidized, wherein the partial reduction or partial oxidation takes place more particularly such that in the finished graphene fiber there is a defined fraction of the transition metal oxide that is smaller than the fraction of the transition metal and that more particularly is less than 10% by weight.

In terms of time, the application of the transition metal or transition metal oxide to the graphene flakes or graphene oxide flakes takes place before the spinning of the graphene fiber or graphene oxide fiber, in other words directly on the starting material for producing graphene fiber. The effect of the partial reduction or partial oxidation in the invention is that the finished graphene fiber comprises transition metal and transition metal oxide between the graphene flakes and in the graphene flakes, and specifically such that the transition metal improves the electrical conductivity primarily between the graphene flakes and the transition metal oxide improves the electrical conductivity primarily in the graphene flakes.

The measures set out in the dependent claims enable advantageous developments and improvements of the process and of the graphene fiber.

It is particularly advantageous if the partial reduction is controlled by defined operating parameters, more particularly by the treatment temperature in the range between 100° C. to 1000° C., very preferably between 100° C. to 500° C., or the treatment time of the partial reduction or the nature of the reducing agent or the fraction of the reducing agent in the process atmosphere.

It is additionally advantageous if the partial oxidation is controlled by defined operating parameters, more particularly by the treatment temperature in the range between room temperature and 300° C., very preferably between 100° C. to 200° C., or the treatment time of the partial oxidation or the nature of the oxidizing agent or the fraction of the oxidizing agent in the process atmosphere.

It is very advantageous if the transition metal or transition metal oxide is present in nanoparticulate form on the graphene flakes or graphene oxide flakes, wherein the nanoparticles more particularly have a maximum size of 100 nm, and/or if the transition metal or transition metal oxide takes the form of an atom or molecule. As a result of the atomic or molecular distribution, a greater activity is achieved in relation to the transition metal oxide or transition metal used. As a result, the graphene fiber of the invention undergoes a smaller increase in density, and the flexural nonrigidity of the graphene fiber is adversely affected to a lesser extent.

It is also advantageous if the transition metal or transition metal oxide is selected from the group of nickel, copper, cobalt, tungsten, molybdenum, iron, zinc, and mixtures thereof. Selecting the transition metal or transition metal oxide in this way enables particularly cost-effective production of the graphene fiber.

According to one advantageous embodiment, the deposition process is a physical vapor deposition, for example a sputtering, a chemical vapor deposition, more particularly an atomic layer deposition, a chemical liquid-phase deposition, more particularly an electrostatic deposition, or a physical liquid-phase deposition, for example an electroless deposition.

It is advantageous, furthermore, if the transition metal or transition metal oxide in the case of atomic layer deposition is applied in a powder bed of graphene flakes or graphene oxide flakes and in the case of the other aforesaid deposition processes in a deposition solution comprising the graphene flakes or graphene oxide flakes in dispersed form. Application in a powder bed is particularly advantageous, since in that case there is no need to separate the graphene flakes or graphene oxide flakes from the deposition solution.

It is advantageous if in a subsequent defect healing step the graphene fiber is heated in the process atmosphere, more particularly at a temperature of not more than 3000° C., more particularly of not more than 1400° C. In this way, defects in the graphene fiber are healed and also, at temperatures of not more than 1400° C., the melting of the transition metals, except for copper and zinc, is avoided.

Also advantageous is graphene fiber (1) comprising graphene flakes, characterized in that transition metal and transition metal oxide is present between the graphene flakes and in the graphene flakes, such that the transition metal improves the electrical conductivity primarily between the graphene flakes and the transition metal oxide improves the electrical conductivity primarily in the graphene flakes.

DETAILED DESCRIPTION

The invention relates to a process for producing graphene fibers, with the process steps described below.

In a first step, single-layer or multilayer graphene flakes or graphene oxide flakes based on graphene or graphene oxide are provided as starting material for the production of the graphene fibers, with the multilayer graphene flakes or graphene oxide flakes being able to have up to ten layers.

In a subsequent second step, a transition metal or a transition metal oxide is applied to the provided graphene flakes or graphene oxide flakes by means of a suitable deposition process. This step serves for the extrinsic doping of the graphene flakes and for improving the electrical conductivity between the graphene flakes in the graphene fiber resulting from the process. Extrinsic doping is intended hereinafter to refer to an operation in which atoms or molecules applied on the surface induce a shift in charge without adversely affecting the charge carrier mobility. The transition metal or transition metal oxide is selected for example from the group of nickel, copper, cobalt, tungsten, molybdenum, iron, zinc, and mixtures thereof. The transition metal or transition metal oxide for application is present for example in nanoparticulate form, with the nanoparticles more particularly having a maximum size of 1000 nm. The transition metal or transition metal oxide here comprises at least one atom or one molecule of a transition metal.

Suitable deposition processes contemplated include, for example, a physical vapor deposition, e.g., a sputtering, a chemical vapor deposition, e.g., an atomic layer deposition, a chemical liquid-phase deposition, e.g., an electrostatic deposition, or a physical liquid-phase deposition, e.g., an electroless deposition. In the case of the vapor depositions, the application of the transition metal or transition metal oxide may take place in a powder bed of graphene flakes or graphene oxide flakes, and in the case of the other aforesaid deposition processes it may take place in a deposition solution comprising graphene flakes or graphene oxide flakes in dispersed form.

For the electrostatic deposition, for example, the application of the transition metal or transition metal oxide takes place in a deposition solution comprising a colloidal dispersion of a transition metal hydroxide and the corresponding transition metal oxide, or a transition metal oxide. When graphene flakes or graphene oxide flakes are dispersed in this deposition solution, the transition metal hydroxide or transition metal oxide attaches to the flakes. The transition metal hydroxide may be selected, for example, from a group comprising $Mo(OH)_3$, $Mo(OH)_4$, $Mo(OH)_5$, WOH, $W(OH)_4$, VOH, $V(OH)_3$, $V(OH_5)$, $H_{0.5}WO_3$, and mixtures thereof.

For a chemical liquid-phase deposition of the transition metal or transition metal oxide, for example, a salt of the transition metal, more particularly a chloride of the transition metal or an ammonium salt of the transition metal oxide, may be dissolved in the deposition solution. The transition metal chloride may be selected, for example, from a group encompassing $MoCl_3$, $MoCl_6$, $WCl_6$, $VCl_3$, $VCl_4$, CuCl, $CuCl_2$, $CoCl_2$, $NiCl_2$, and mixtures thereof. The ammonium salt of the transition metal oxide may be selected, for example, from a group consisting of $(NH_4)_2MoO_4$, $(NH_4)_6Mo_7O_{24}\cdot 4H_2O$, $(NH_4)10(H_2W_{12}O_{42})\cdot 4H_2O$, $NH_4VO_3$ and mixtures thereof. Subsequently the graphene flakes or graphene oxide flakes are then dispersed in this deposition solution, with the chlorides or ammonium salts attaching to the graphene flakes or graphene oxide flakes. As a result of the addition, for example, of hydrazine hydrate as a strong reagent, the chlorides of the transition metal are reduced, and so the corresponding transition metals are formed from the attached chlorides or ammonium salts, these metals remaining attached on the graphene flakes or graphene oxide flakes.

For an electroless deposition of the transition metal it is possible, for example, to dissolve a chloride and/or a sulfate of the transition metal in the deposition solution by means of complexing agents, from the group, for example, of $C_{10}H_{14}N_2Na_2O_8\cdot 2H_2O$, $KNaC_4H_4O_6\cdot 4H_2O$, and $Na_3C_6H_5O_7\cdot 2H_2O$. The transition metal sulfate may be selected, for example, from the group consisting of $NiSO_4$, $CuSO_4$, and $CoSO_4$, and mixtures thereof. Here as well, subsequently the graphene flakes or graphene oxide flakes are dispersed in the deposition solution. Attaching to them in this case are the transition metal ions. Through the addition of a reducing agent, from the group, for example, of HCHO, $NaBH_4$, and $NaH_2PO_2\cdot H_2O$, into the deposition solution, the attached transition metal ions are reduced to transition metals.

In a subsequent third step, a spinning solution is produced, comprising in dispersion the graphene flakes or graphene oxide flakes obtained from the second step. The spinning solution produced is used for spinning, more particularly wet spinning or dry spinning, a graphene fiber or graphene oxide fiber, by injection of the spinning solution through a spinneret into a liquid phase or vapor phase. The spinning solution solidifies in a known way in the spinneret to form the filament.

In a subsequent fourth step, the graphene fiber or graphene oxide fiber produced is subjected to thermal treatment, with chemical reduction, for example, in a process atmosphere containing a reducing agent, hydrogen for example, at a defined treatment temperature. Where a graphene oxide fiber is present, it is reduced to a graphene fiber in the fourth step.

Furthermore, the graphene fiber or graphene oxide fiber is treated in the invention such that in the fourth step the transition metal oxide is only partially reduced. Alternatively the graphene fiber or graphene oxide fiber may be treated in the invention such that in the fourth step the transition metal is completely reduced and in a step following the fourth step is partially oxidized. In this way the graphene fiber is doped both by the transition metal and by the corresponding transition metal oxide. Owing to the higher doping activity of the transition metal oxide, the graphene fiber of the invention achieves a higher electrical conductivity.

In both embodiments, the treatment takes place such that the finished graphene fiber comprises a defined fraction of the transition metal oxide that is smaller than the fraction of the transition metal and that more particularly is less than 10% by weight.

The partial reduction is controlled by defined operating parameters, for example by the treatment temperature, which is situated, for example, in the range between 100 to 1000° C., very preferably between 100 and 500° C. Other relevant operating parameters are, for example, the treatment time of the partial reduction or the nature of the reducing agent or the fraction of the reducing agent in the process atmosphere.

The partial oxidation in accordance with the alternative embodiment is also controlled by defined operating parameters, more particularly by the treatment temperature, which is situated, for example, in the range between room temperature and 300° C., very preferably between 100° C. to 200° C. Other relevant operating parameters are, for example, the treatment time of the partial oxidation or the nature of the oxidizing agent or the fraction of the oxidizing agent in the process atmosphere.

The graphene fiber may additionally be heated for defect healing in an inert atmosphere in a subsequent fifth step, at a temperature, for example, of not more than 3000° C., more particularly of not more than 1400° C.

The process of the invention leads to a finished graphene fiber with graphene flakes, with transition metal and transition metal oxide being present between the graphene flakes and in the graphene flakes, such that the transition metal improves the electrical conductivity primarily between the graphene flakes and the transition metal oxide improves the electrical conductivity primarily in the graphene flakes.

From a multiplicity of graphene fibers of the invention it is possible in a known way to produce a yarn. It is additional possible to produce an electrical component, more particularly a semiconductor component, or an electrical conductor from the graphene fiber of the invention or from the yarn comprising the graphene fibers of the invention.

The invention claimed is:

1. A process for producing graphene fibers, the process comprising the steps:

a. providing single-layer or multilayer graphene flakes or graphene oxide flakes based on graphene or on graphene oxide, b. applying a transition metal or a transition metal oxide to the graphene flakes or graphene oxide flakes by a deposition process, c. spinning a graphene fiber or graphene oxide fiber by injection of a spinning solution comprising in dispersed form the graphene flakes or graphene oxide flakes obtained from step b), d. treating the graphene fiber or the graphene oxide fiber in a process atmosphere containing a reducing agent at a defined treatment temperature, wherein a graphene oxide fiber, if present, is reduced to a graphene fiber, wherein the graphene fiber or graphene oxide fiber is treated such that the transition metal oxide in step d) is only partially reduced or such that the transition metal in a step following step d) is partially oxidized.

2. The process as claimed in claim 1, characterized in that the partial reduction is controlled by defined operating parameters, or the treatment time of the partial reduction or the nature of the reducing agent or the fraction of the reducing agent in the process atmosphere.

3. The process as claimed in claim 1, characterized in that the partial oxidation is controlled by defined operating parameters, or the treatment time of the partial oxidation or the nature of the oxidizing agent or the fraction of the oxidizing agent in the process atmosphere.

4. The process as claimed in claim 1, characterized in that the transition metal or transition metal oxide is in nanoparticulate form, or in that the transition metal or transition metal oxide takes the form of an atom or molecule.

5. The process as claimed in claim 1, characterized in that the transition metal or transition metal oxide is selected from the group of nickel, copper, cobalt, tungsten, molybdenum, iron, zinc, and mixtures thereof.

6. The process as claimed in claim 1, characterized in that the deposition process is a physical vapor deposition, a chemical vapor deposition, a chemical liquid-phase deposition, or a physical liquid-phase deposition.

7. The process as claimed in claim 6, characterized in that the transition metal or transition metal oxide is applied in a deposition solution comprising the graphene flakes or graphene oxide flakes in dispersed form, or in a powder bed of graphene flakes or graphene oxide flakes.

8. The process as claimed in claim 1, characterized in that in a subsequent defect healing step the graphene fiber is heated in an inert atmosphere.

9. A graphene fiber (1) comprising graphene flakes, characterized in that transition metal and transition metal oxide is present between the graphene flakes and in the graphene flakes, such that the transition metal improves the electrical conductivity primarily between the graphene flakes and the transition metal oxide improves the electrical conductivity primarily in the graphene flakes.

10. A yarn comprising a multiplicity of graphene fibers (1) as claimed in claim 9.

11. An electrical component comprising a graphene fiber (1) as claimed in claim 9.

12. An electrical conductor comprising a graphene fiber (1) as claimed in claim 9.

13. An electrical component comprising a yarn as claimed in claim 10.

14. An electrical conductor comprising a yarn as claimed in claim 10.

15. A process for producing graphene fibers, the process comprising the steps:

a. providing single-layer or multilayer graphene flakes or graphene oxide flakes based on graphene or on graphene oxide, b. applying a transition metal or a transition metal oxide to the graphene flakes or graphene oxide flakes by a deposition process, c. wet spinning or dry spinning a graphene fiber or graphene oxide fiber by injection of a spinning solution comprising in dispersed form the graphene flakes or graphene oxide flakes obtained from step b), d. reducing the graphene fiber or the graphene oxide fiber in a process atmosphere containing hydrogen at a defined treatment temperature, wherein a graphene oxide fiber, if present, is reduced to a graphene fiber, wherein the graphene fiber or graphene oxide fiber is treated such that the transition metal oxide in step d) is only partially reduced or such that the transition metal in a step following step d) is partially oxidized, wherein the partial reduction or partial oxidation takes place such that in the finished graphene fiber there is a defined fraction of the transition metal oxide that is less than 10% by weight.

16. The process as claimed in claim 15, characterized in that the partial reduction is controlled by the treatment temperature in the range between 100° C. to 1000° C., or the treatment time of the partial reduction or the nature of the reducing agent or the fraction of the reducing agent in the process atmosphere.

17. The process as claimed in claim 15, characterized in that the partial oxidation is controlled by the treatment temperature in the range between room temperature and 300° C., or the treatment time of the partial oxidation or the nature of the oxidizing agent or the fraction of the oxidizing agent in the process atmosphere.

18. The process as claimed in claim 15, characterized in that the partial reduction is controlled by the treatment temperature in the range between 100° C. to 500° C., or the treatment time of the partial reduction or the nature of the reducing agent or the fraction of the reducing agent in the process atmosphere.

19. The process as claimed in claim 15, characterized in that the partial oxidation is controlled by the treatment temperature in the range between 100° C. to 200° C., or the treatment time of the partial oxidation or the nature of the oxidizing agent or the fraction of the oxidizing agent in the process atmosphere.

20. The process as claimed in claim 15, characterized in that the transition metal or transition metal oxide is in nanoparticulate form, wherein the nanoparticles have a maximum size of 100 nm, or in that the transition metal or transition metal oxide takes the form of an atom or molecule.

21. The process as claimed in claim 15, characterized in that the deposition process is a sputtering, an atomic layer deposition, an electrostatic deposition, or an electroless deposition.

22. The process as claimed in claim 15, characterized in that in a subsequent defect healing step the graphene fiber is heated in an inert atmosphere, at a temperature of not more than 3000° C.

23. The process as claimed in claim 15, characterized in that in a subsequent defect healing step the graphene fiber is heated in an inert atmosphere, at a temperature of not more than 1400° C.

* * * * *